United States Patent [19]

Strohmeyer

[11] 4,127,184

[45] Nov. 28, 1978

[54] COMBINATION FLOWER BOX AND FIRE ESCAPE

[76] Inventor: Robert W. Strohmeyer, 214 Bethel Rd., Mooresville, Ind. 46158

[21] Appl. No.: 860,695

[22] Filed: Dec. 15, 1977

[51] Int. Cl.[2] ..... E06C 9/14

[52] U.S. Cl. ..... 182/70; 182/20; 182/129; 182/196

[58] Field of Search ..... 182/129, 20, 70, 71, 182/73, 74, 76, 196–198

[56] References Cited

U.S. PATENT DOCUMENTS 3,344,886 10/1967 Boscarino ..... 182/70

FOREIGN PATENT DOCUMENTS 686,130 5/1964 Canada ..... 182/70

*Primary Examiner*—Reinaldo P. Machado
*Attorney, Agent, or Firm*—Jenkins, Coffey & Hyland

[57] ABSTRACT

A combination plant box and fire escape ladder includes an anchor rail for fixed attachment to an outside wall of a building, a frame for holding a top rung of the ladder outwardly from the wall, a pair of flexible cables forming the ladder rails, and a plurality of lower rungs. The plant box is attached to the flexible rail ends remote from the top rung, and the lower rungs are attached to the flexible rails between the top rung and plant box. The frame includes a center portion lying adjacent the wall and two end portions which project generally perpendicularly from the center portion and the wall to support the top rung. The anchor rail is provided with a pair of attachment points by which the frame is attached to the anchor rail. The upper ends of the flexible rails are attached to respective attachment points of the anchor rail and extend through the top rung to fix the lower rungs in spaced apart relation from the wall. Each lower rung is in the form of a hollow tube with opposed passageways at each of its ends. Each flexible rail extends through one pair of the passageways at a respective end of the tube. Cable clamps fix the positions of the rungs with respect to each of the flexible rails. The flexible rails pass freely slidably through the passageways in each end of the tube, such that the lengths of flexible rail between each pair of adjacent rungs can be stored within the hollow tube forming one of the adjacent rungs when the fire escape ladder is in a stored position. The ladder further includes a tray for use when the ladder is in a storage position, the tray including a downwardly opening channel adjacent the front edge thereof, a botton and a back. The top rung is received in the downwardly opening channel with the bottom supporting the stored rungs and rails, and the back lying adjacent the frame back member to hold the tray in position.

15 Claims, 6 Drawing Figures

COMBINATION FLOWER BOX AND FIRE ESCAPE

This invention relates to flexible fire escape ladders for permanent attachment to building structures, and particularly to a fire escape ladder housed within a decorative and ornamental plant box for attachment to a structure beneath an exterior window thereof.

Several types of storable fire escape devices are known. Such devices are described in, for example, Kimball et al, U.S. Pat. No. 458,023; Barron, U.S. Pat. No. 1,053,135; Smith, U.S. Pat. No. 1,123,029; Blaufeld, U.S. Pat. No. 1,723,129; Martin, U.S. Pat. No. 1,753,798; and, Dahlander, U.S. Pat. No. 2,388,678. Attempts have been made in the past to disguise or camouflage the fire escape ladder and associated mounting apparatus, since typically, such apparatus when mounted either on the outside or inside of a building structure, detracts from the appearance of such structure. Various kinds of disguising enclosures are known. For example, the aforementioned U.S. Pat. No. 458,023 discloses a covering assembly for a fire escape ladder which is stored within a building structure. Boscarino, U.S. Pat. No. 3,344,886 discloses a fire escape ladder for storage externally of a structure, the ladder and associated components being disguised as an ornamental flower box.

It is an object of the present invention to provide an improved storage and camouflage structure for an externally stored fire escape ladder. The ladder and accompanying structure of the instant invention is simpler and more economical to construct than known prior art structures, and is simple and easy to mount and maintain on an exterior wall of a structure.

According to the invention, a combination ornamental plant box and fire escape ladder includes an anchor rail for fixed attachment to a wall of a structure, the anchor rail including means for selectively supporting the plant box, a frame for holding a top rung of the ladder outwardly from the wall, the frame including a center portion lying adjacent the wall and a pair of end portions for supporting the top rung, the end portions projecting generally perpendicular to the wall and supported by the center portion. The combination further includes means for suspending the frame from the anchor rail, a pair of flexible members for forming the stringers or rails of the ladder, the upper ends of the flexible members being attached to the anchor rail and extending through the top rung to fix the rails in spaced-apart relation from the wall and from each other. Actuation of the selective support means permits the plant box to fall from the anchor rail, pulling the fexible members toward the bottom of the wall to their fully extended positions to deploy the ladder. The ladder further includes a plurality of members providing lower rungs of the ladder, the members being attached to the flexible members intermediate the top rung and the plant box.

According to an illustrative embodiment, each of the rungs is a rigid hollow tube, the two ends of which each include two opposed passageways sized for passage of the flexible members therethrough. One of the flexible members passes through the opposed passageways at one end of each tube and the other flexible member passes through the opposed passageways at the other end of the flexible tube. Clamp means, such as a cable clamp, is attached to each flexible member within the ends of each tube to fix the positions of the various lower rungs with respect to the flexible members. The length of each flexible member between rungs can be pushed into either of the two adjacent tubes when the ladder is in the storage position.

Additionally, according to the invention, the apparatus includes a tray having a use position for supporting the intermediate rungs, the tray including a back portion and a bottom portion. The bottom portion provides a downwardly opening channel which engages the top rung when the tray is in its use position, the back of the tray lying adjacent the center portion of the frame when the tray is in the use position, the tray bottom portion providing a storage platform for the lower rungs when the ladder is in its stored position.

In the illustrative embodiment, the flexible members forming the ladder stringers or rails are woven wire cables. The anchor rail includes a pair of spaced-apart hooks which project outwardly from the wall. The frame center portion includes a pair of equally spaced-apart holes for engagement by the hooks to hold the frame against the wall. The top rung also includes a pair of diametrically opposed passageways adjacent each of its ends through which the cables extend.

The invention may best be understood by referring to the following description and accompanying drawings which illustrate the invention. In the drawings.

Figure 1:
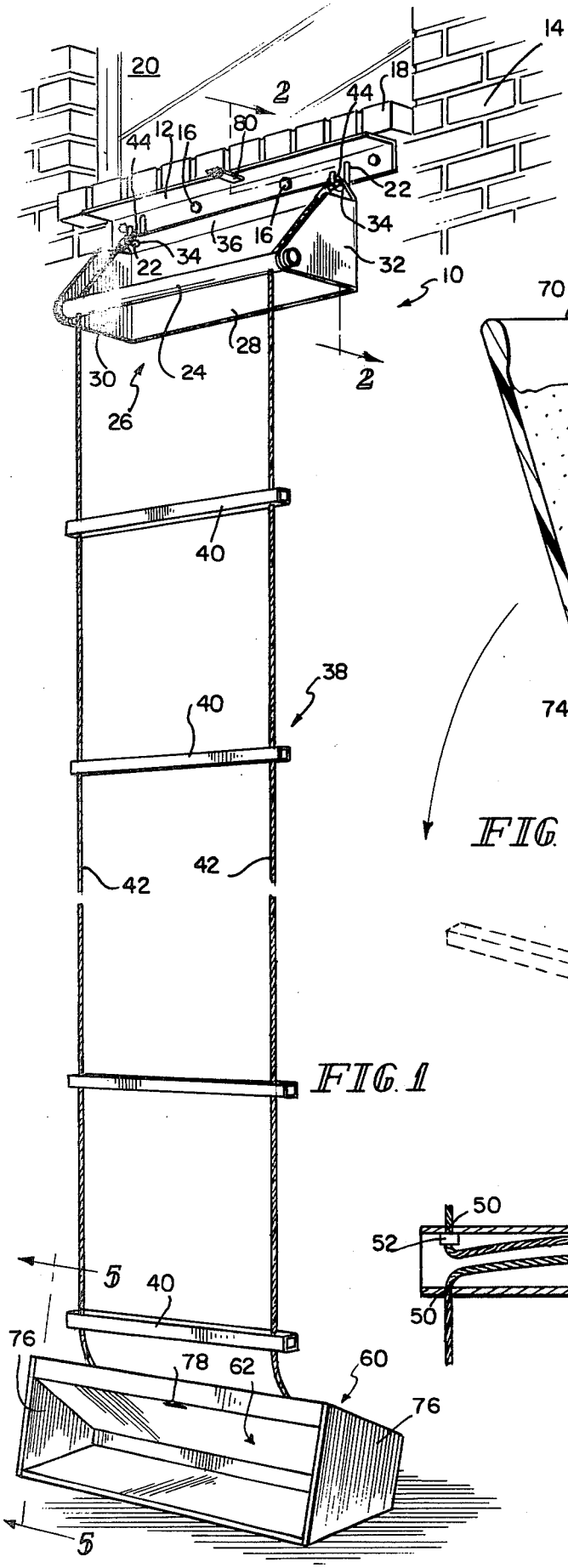
FIG. 1 is a fragmentary perspective view of a device constructed according to the present invention, with the fire escape ladder in the deployed position.
Figure 2:
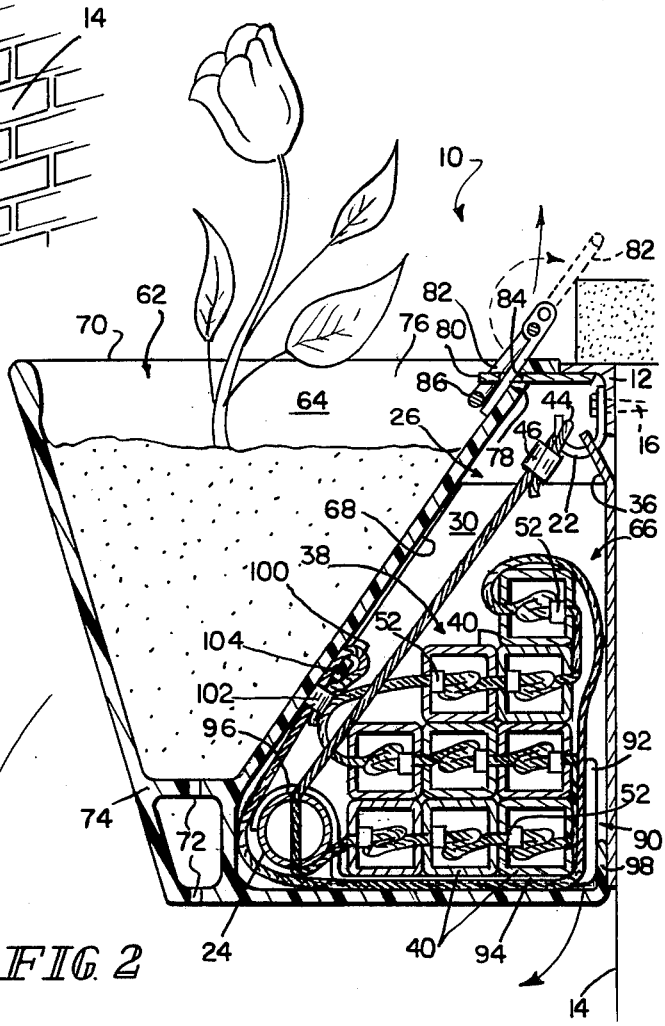
FIG. 2 is a sectional view of the apparatus of FIG. 1 taken generally along section lines 2—2 thereof, with the fire escape ladder in a stored position.

Referring now to the drawings, and particularly to FIGS. 1–2, the combination window box and fire escape ladder 10 of the instant invention includes an angle iron anchor rail or bar 12 securely anchored to the outer side wall 14 of a building structure. Anchor rail 12 is anchored to wall 14 by any suitable means, illustratively, a plurality of anchor bolts 16. Anchor rail 12 is located on the wall 14 directly beneath the sill 18 of an emergency exit window 20.

Anchor rail 12 includes a pair of spaced-apart attachment points 22, which are in the form of a pair of upwardly and outwardly opening hooks, the shanks of which are secured to anchor rail 12 by any suitable means, such as welding. A top rung 24, which is in the shape of a right circular cylindrical hollow tube, is secured to the anchor rail 12 by a top rung support frame 26 comprising an elongated, generally rectangular back or center portion 28 which extends generally parallel to the wall 14, and two outstanding end portions or ears 30, 32 which extend generally perpendicular to the wall 14 and support top rung 24 outwardly from the wall therebetween. The center portion 28 is provided with a pair of holes 34 adjacent its upper edge 36. Holes 34 are spaced apart the same distance as hooks 22, and, as best illustrated in FIG. 2, the upper edge 36 of the center portion 28 is formed with a flange which extends slightly upwardly and outwardly from wall 14 so that center portion 28 may lie immediately adjacent wall 14 when the top rung support frame 26 is positioned on hooks 22. Top rung 24 is secured to ears 30, 32 by forming in ears 30, 32 axially aligned circular holes having diameters equal to the outside diameter to top rung 24, then inserting top rung 24 through the holes and welding or pinning the top rung in place.

The escape ladder 38 of apparatus 10 further includes a plurality of lower rungs 40 which, for ease of stacking and storage in the instant embodiment, are right rectangular cylindrical tubes. Rungs 40 are attached to one another and to top rung 24 by a pair of spaced-apart flexible escape ladder rail members 42. In the illustrative embodiment, the flexible rails are woven wire ropes or cables. Rails 42 are provided with loops 44 at their upper ends, the loops 44 being formed with cable clamps 46. Loops 44 are attached over hooks 22 to support the ladder 38.

The side walls of each of top rung 24 and lower rungs 40 are provided with a pair of opposed holes 50 adjacent each end thereof. Each of the rails 42 is threaded through the pairs of holes 50 at a respective end of top rung 24, then through holes 50 at a respective end of each of the lower rungs 40. Lower rungs 40 are retained in vertically spaced-apart relation on rails 42 by positioning a cable clamp 52 about each rail 42 within each lower rung 40. The cable clamps 52 position the lower rungs 40 vertically when the escape ladder 38 is in the deployed position, illustrated in FIG. 1. The provision of a pair of holes 50 at each end of top rung 24 assures that the escape ladder 38, when deployed, is suspended outwardly from the wall 14 a sufficient distance so that it may be used conveniently, safety and easily by persons escaping through window 20.

Figure 5:
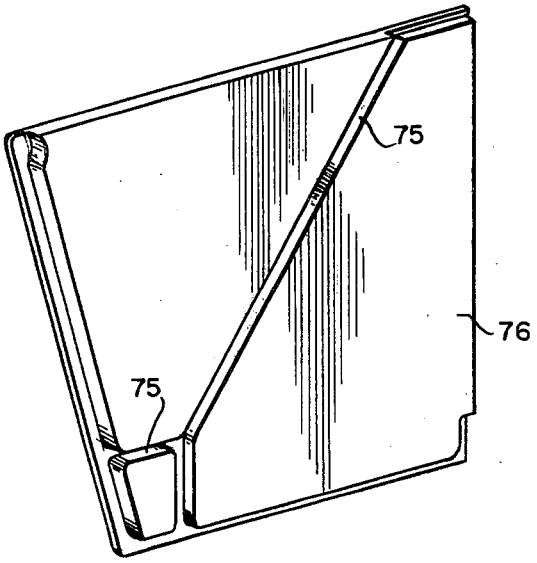
FIG. 5 is a sectional view taken generally along section lines 5—5 of FIG. 1 to show structural details of the device.

The combination window box and cover 60 of the instant invention is generally trapezoidal prism-shaped, the interior of the combination window box and cover 60 being divided by a longitudinal partition 62 into a window box portion 64 and an escape ladder 38 covering and storage portion 66. Each of the window box portion 64 and storage portion 66 is somewhat V-shaped in transverse sections, as best illustrated in FIG. 2, with the back 68 of storage portion 66 and the top 70 of window box portion 64 both open. Top 70 is open to receive, e.g., soil to support plants. Back 68 is open to permit entry of the stored escape ladder 38 components, as will be described hereinafter. Desirably, the combination window box and cover 60 may also include a plurality of drain holes 72 along the bottom thereof for the window box portion 64. The illustrative combination window box and escape ladder cover 60 is constructed from a plastic extrusion 74 to the ends of which are attached, e.g., by gluing with a suitable adhesive, a pair of end caps 76 having groove portions 75 (FIG. 5) formed therein for receiving the walls of the extrusion 74.

Longitudinal partition 62 of the combination window box and cover 60 is provided with a longitudinally elongated slot 78 adjacent its upper extent. Anchor rail 12 is provided with an additional attachment point 80 in the form of an elongated flat metal tonque which protudes from rail 12 generally perpendicular to wall 14 and is positioned along the rail such that, when the combination window box and cover 60 is accurately positioned on frame 26, tongue 80 extends through slot 78. A linch pin 82 is provided for insertion through a hole 84 in the outer end of tongue 80. When in position, the linch pin 82 lies outside and above partition 62 within easy reach of persons at window 18. The linch pin 82 is of a type which includes a snap ring 86 having two stable positions illustrated in solid and broken lines in FIG. 2. The first of these stable positions places the snap ring 86 over the outwardly projecting end of tongue 80 to prevent linch pin 82 from being accidentally dislodged from hole 84. The second of these stable positions, illustrated in broken lines, permits the ring 86 to be used as a handgrip to assist in removal of the linch pin 82 from hole 84 when it is desired to deploy the fire escape ladder 38.

Figure 3:
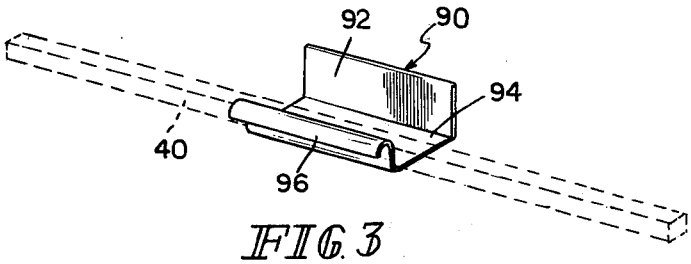
FIG. 3 is a perspective view of a detail of the apparatus illustrated in FIGS. 1–2.

The apparatus 10 additionally includes a tray 90 (FIGS. 2, 3) for supporting the lower rungs 40 when such rungs are in the storage position, illustrated in FIG. 2. The tray includes a back portion 92 which, when the tray 90 is in the use position, lies adjacent the center portion 28 of the frame 26. Tray 90 further includes a bottom portion 94 for supporting the lower rungs 40, and a downwardly opening channel 96 which is generally semicircular in section transverse to the longitudinal extent of the combination window box and cover 60. The combination window box and cover 60 includes an upwardly extending lip 98 which lies between back portion 92 and the frame center portion 28 when the ladder 38 is stored, as illustrated in FIG. 2. The lower rungs 40 rest upon the bottom portion 94.

When the escape ladder 38 is to be deployed, linch pin 82 is removed as above described, and the combination window box and cover 60 falls away from anchor rail 12. The resulting movement of lip 98 as cover 60 falls away pulls the back portion 92 of tray 90 downwardly, pivoting the tray 90 about the axis of top rung 24 and channel 96. Tray 90 falls away from top rung 24, permitting the ladder 38 to be deployed. To insure that the ladder is fully and completely deployed, the lower ends of rails 42 are attached to the storage portion 66 side wall of partition 62 of the combination window box cover 60. The weight of the cover 60 falling away from anchor rail 12 aids to deploy ladder 38. The bottom ends of rails 42 may be attached to the combination windox box and cover 60 in any suitable manner. Illustratively, loops 100 are formed, with the aid of cable clamps 102 in the bottoms of flexible rails 42, the loops engaging loops or hooks 104 provided on the storage portion 66 side of partition 62.

Figure 4:
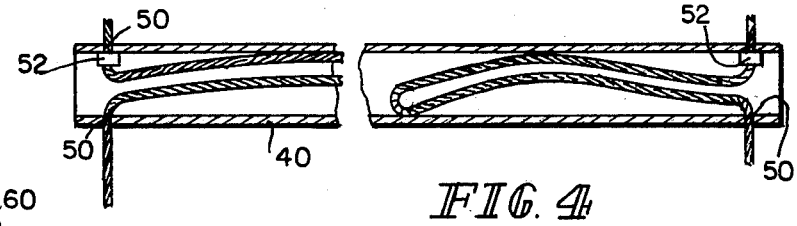
FIG. 4 is a longitudinal sectional view of a rung of the fire escape ladder of FIGS. 1–2.

As best illustrated in FIGS. 2, 4, the hollow tubular lower rungs 40 are used advantageously to store ladder 38. Since rails 42 are flexible, the length of each flexible rail 42 between adjacent lower rungs 40 may be pushed into the length of either rung 40 of the adjacent pair to store most of the length of rail 42 within rungs 40.

Figure 6:
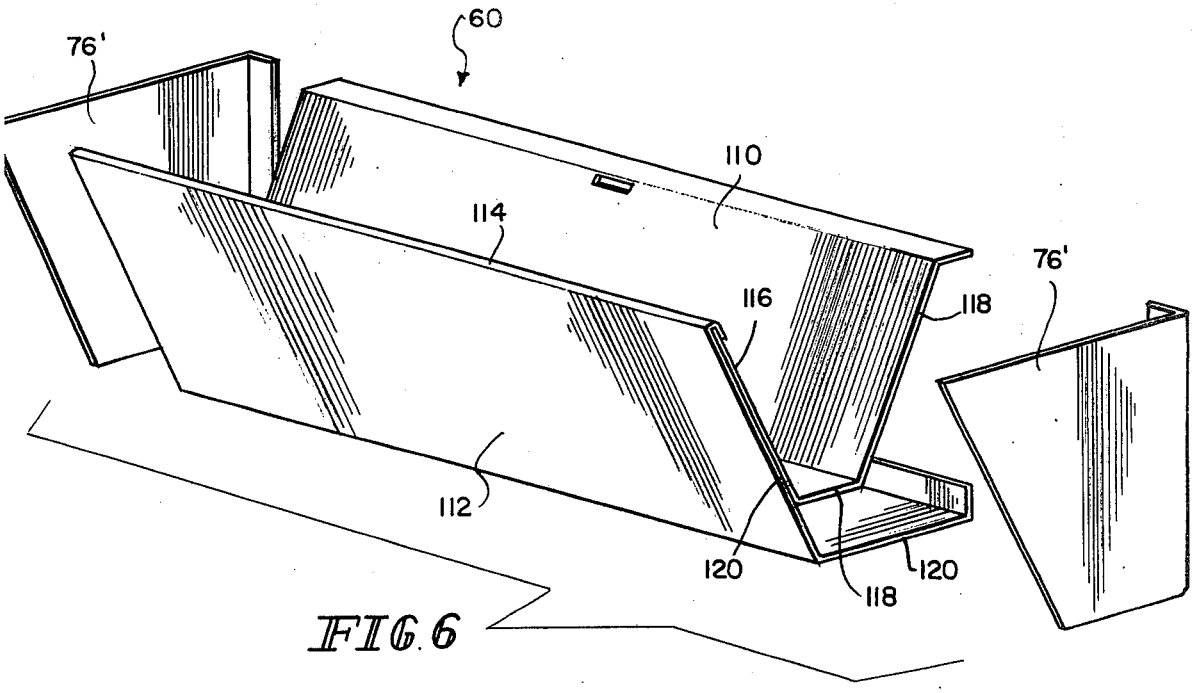
FIG. 6 is a fragmentary perspective view of another combination window box and fire ecape cover constructed according to the present invention.

In another embodiment illustrated in FIG. 6, the combination window box and cover 60 was constructed from an inner V-shaped trough 110 of 20 ga. steel, or outer, more open V-shaped panel 112 of 20 ga. steel, welded at its outer top edge 114 to the outer top edge 116 of the inner V-shaped member 110, and a pair of 12 ga. end caps 76' wire-welded at 118 to the inside of the inner V-shaped member 110 and arc welded at 120 along the outside of the outer panel 112.

In one device constructed according to the present invention, the anchor rail 12 was a $1 \times 2\frac{1}{2} \times 26$ inch angle iron. Hooks 22 were formed from three-eighth inch diameter stock, and spaced apart 19 inches. The top rung support frame 26 was formed from 12 ga. galvanized steel, as was the tray 90. Top rung 24 was formed from 16 ga. steel tubing. Lower rungs 40 were formed from 15 ga. square steel tubing. The diameter of rung 24 was 1 inch. The length of top rung 24 was 20½ inches. The dimensions of each lower rung 40 were 1 × 1 × 18½ inches. The top rung 24 was positioned in ears 30, 32 by placing pins through opposed bores at either end of the top rung 24 outside of ears 30, 32.

What is claimed is:

1. A combination window box and fire escape comprising means for anchoring the escape assembly to a wall adjacent an emergency exit, the anchor means providing a first pair of attachment points and a second attachment point, a top rung for the escape, top rung support means including an elongated center portion lying adjacent the wall and outstanding end portions extending perpendicular to the wall for supporting the top rung therebetween outwardly from the wall, the top rung support means being supported by the anchor means, a plurality of lower rungs, a pair of flexible rail members for supporting the lower rungs of the escape, each of the lower rungs being attached to the flexible members to extend generally perpendicularly therebetween in spaced-apart relation to the next superjacent rung, a combination window box and cover for the escape when stored, the combination window box and cover being removably secured to the second attachment point when in the escape storing position, and including a window box portion and a separate portion for covering the stored escape, the combination window box and cover being secured to the distal ends of the flexible rail members to pull the rail members and lower rungs downward when the escape is being deployed.

2. The apparatus of claim 1 wherein the combination window box and cover is generally trapezoidal prism shaped, the interior of the combination window box and cover being divided by a longitudinal partition into the window box portion and the covering portion, each of such portions being somewhat V-shaped in transverse section.

3. The apparatus of claim 1 wherein each of the lower rungs is constructed from a hollow tubular member having at least one side wall with a pair of opposed passageways through the at least one side wall at each end thereof, each of the flexible rail members extending through a respective pair of opposed passageways at one end of each lower rung, and a plurality of cable clamps, one attached to each flexible rail adjacent the at least one side wall of each lower rung to fix the positions of the ends of each lower rung vertically on the flexible rails.

4. The apparatus of claim 3 wherein the vertical length of each flexible rail between adjacent lower rungs is stored within the interior of one of such adjacent lower rungs when the escape is in its stored position.

5. The apparatus of claim 3 wherein the cable clamps are positioned inside the ends of respective lower rungs.

6. The apparatus of claim 1 wherein each flexible rail is a rope.

7. The apparatus of claim 6 wherein the rope is a metal rope.

8. The apparatus of claim 1 wherein the first pair of attachment points comprises a pair of upwardly and outwardly opening hooks, the shanks of which are secured to the anchor means.

9. The apparatus of claim 8 wherein the flexible rails are provided with loops at their upper ends, the loops being closed by cable clamps, and the loops are disposed on the hooks to anchor the upper ends of the flexible rails to the anchor means.

10. The apparatus of claim 8 wherein the top rung support means center portion includes means defining a pair of holes for engagement by the hooks of the first pair of attachment points.

11. The apparatus of claim 1 wherein the top rung is formed from a tubular member having at least one side wall provided with a pair of generally opposed passageways adjacent each end thereof, the flexible rails being threaded through pairs of passageways at their respective ends of the top rung to support the flexible rails outwardly from the wall.

12. The apparatus of claim 1 wherein the anchor means includes an angle iron and means for attaching the angle iron to the wall, the emergency exit is a window and the angle iron is attached to the wall beneath and adjacent the sill thereof.

13. The apparatus of claim 1 wherein the second attachment point comprises a flat rigid metal tongue which extends outwardly generally perpendicular to the wall and includes means defining a hole adjacent its distal end, the combination window box and cover including a wall providing a slot through which the tongue extends when the combination window box and cover is in position covering the escape, and a pin for insertion into the hole to fix the combination window box and cover to the tongue.

14. The apparatus of claim 13 wherein the pin is a linch pin with an over-center locking ring.

15. The apparatus of claim 1 and further including a tray having a use position for supporting the lower rungs, the tray including a back portion and a bottom portion providing a downwardly opening channel for engaging the top rung when the tray is in its use position, the back lying adjacent the center portion of the top rung support means when the tray is in the use position, the combination plant box and cover including an upwardly extending lip lying between the tray back and the support means center portion to urge the tray from its storage position when the combination plant box and cover is disconnected from the second attachment point, the tray moving generally pivotally about the top rung to its disposed position, the tray bottom portion providing a storage platform for the intermediate rungs when the ladder is in its stored orientation.

* * * * *